US008438739B2

(12) United States Patent
Fujii

(10) Patent No.: US 8,438,739 B2
(45) Date of Patent: May 14, 2013

(54) SCISSORS

(75) Inventor: Akio Fujii, Tokyo (JP)

(73) Assignee: Raymay Fujii Corporation, Koto-Ku (JP)

( * ) Notice: Subject to any disclaimer, the term of this patent is extended or adjusted under 35 U.S.C. 154(b) by 483 days.

(21) Appl. No.: 12/624,619

(22) Filed: Nov. 24, 2009

(65) Prior Publication Data

US 2010/0299940 A1 Dec. 2, 2010

(30) Foreign Application Priority Data

May 29, 2009 (JP) ..... 2009-003579

(51) Int. Cl.
*B26B 13/12* (2006.01)

(52) U.S. Cl.
USPC ..... 30/232; 30/254

(58) Field of Classification Search ..... 30/231, 30/232, 254, 255, 296.1, 298, 341; 76/106.5; D8/57
See application file for complete search history.

(56) References Cited

U.S. PATENT DOCUMENTS

| | | | | | |
|---|---|---|---|---|---|
| 200,754 | A | * | 2/1878 | Pinchon | 30/255 |
| 1,409,978 | A | * | 3/1922 | Smith | 30/255 |
| 2,158,277 | A | * | 5/1939 | Dolph | 30/341 |
| D137,344 | S | * | 2/1944 | Schlesinger | D8/57 |
| 2,571,675 | A | * | 10/1951 | Bray | 30/341 |
| 2,575,861 | A | * | 11/1951 | Bray | 30/341 |
| 3,491,444 | A | * | 1/1970 | Somervell et al. | 30/254 |
| 3,750,282 | A | * | 8/1973 | Eaton et al. | 30/254 |
| 3,766,648 | A | * | 10/1973 | Chundelak, Jr. | 30/255 |
| 3,781,992 | A | * | 1/1974 | Barr | 30/255 |
| 4,054,991 | A | * | 10/1977 | Bahr | 30/231 |
| 4,140,124 | A | * | 2/1979 | Curutchet | 30/232 |
| 5,007,170 | A | * | 4/1991 | Mayama | 30/232 |
| 5,953,823 | A | * | 9/1999 | Huang | 30/232 |
| D459,642 | S | * | 7/2002 | Haquin | D8/57 |
| D488,364 | S | * | 4/2004 | Wong | D8/57 |
| 6,915,578 | B2 | * | 7/2005 | Yusufov et al. | 30/232 |
| D540,648 | S | * | 4/2007 | Junck | D8/107 |
| D575,121 | S | * | 8/2008 | Junck | D8/5 |
| 7,458,160 | B2 | * | 12/2008 | Escobar et al. | 30/232 |
| 7,941,928 | B2 | * | 5/2011 | Fisher | 30/254 |
| 2002/0129497 | A1 | * | 9/2002 | Lyddon et al. | 30/232 |
| 2009/0271987 | A1 | * | 11/2009 | Fisher | 30/254 |
| 2011/0047801 | A1 | * | 3/2011 | Castley et al. | 30/232 |
| 2012/0174415 | A1 | * | 7/2012 | Sataloff | 30/232 |

FOREIGN PATENT DOCUMENTS

| | | | | |
|---|---|---|---|---|
| EP | 2255934 | A1 | * | 12/2010 |
| GB | 2128920 | A | * | 5/1984 |
| JP | 63-063485 | A1 | | 3/1988 |
| JP | 03049793 | A | * | 3/1991 |

* cited by examiner

*Primary Examiner* — Jason Daniel Prone
(74) *Attorney, Agent, or Firm* — Burr & Brown

(57) ABSTRACT

A scissors includes a pair of scissors constitution bodies which have a cutting portion and a holding portion formed continuously from the cutting portion. The cutting portion has cutter blades formed on both sides in a width direction. The pair of scissors constitution bodies are rotatably joined by a shaft portion in a base end portion of the cutting portion. The pair of scissors constitution bodies cross and rotate in both directions through the shaft portion. The holding portion includes a handle portion mounted therein so as to be visually unrecognized from the outside, the handle portion projected only in one width direction. A slider provided in the holding portion is operated to form a handle portion.

2 Claims, 2 Drawing Sheets

SCISSORS

CROSS REFERENCE TO RELATED APPLICATION

This application claims the benefit under 35 USC §119(a)-(d) from Japanese Patent Application No. U 2009-003579, filed May 29, 2009.

FIELD OF THE INVENTION

The present invention relates to a scissors, in particular, to a scissors which can be used by both a right-handed person and a left-handed person without sense of incompatibility.

BACKGROUND OF THE INVENTION

Although a right-handed scissors has been conventionally common, a left-handed scissors also has existed. However, in the case of a scissors designed for the exclusive use of a dominant hand, the gradient angles of finger ring portions of a holding portion in a width direction are different. Accordingly, when the scissors is not used exclusively by the dominant hand, it is very hard to use the scissors.

Then, FIG. 4 shows an example of an "ambidextrous scissors" 40, which can be used by both right-handed and left-handed users without sense of incompatibility that has been conventionally proposed.

The conventional "ambidextrous scissors" 40 has a pair of scissors constitution bodies 44 and 44 provided with a cutting portion 42 having a plane rectangle shape and having cutter blades 41 and 41 formed on both sides in a width direction and a holding portion 43 formed continuously from an end portion of the cutting portion 42 in a length direction. The pair of scissors constitution bodies 44 and 44 can rotate in both directions through a shaft portion 46. Handle forming portions 45 and 45 are mounted in the holding portion 43 on both sides in a width direction, respectively. The handle forming portions 44 and 44 of the scissors constitution bodies 44 are pulled out in the opposite width direction to constitute the scissors 40. The scissors 40 can be used by both the right-handed and left-handed users without sense of incompatibility.

However, the conventional scissors 40 exhibit a defect in which it is cumbersome to pull out the handle forming portions 45 and 45 with fingers in the width direction in use, and it may be impossible to use the scissors 40 smoothly.

Also, the conventional scissors 40 exhibit a defect in which the conventional scissors 40 has poor appearance quality since the handle forming portions 45 and 45 are provided so that the handle forming portions 45 and 45 can be visually recognized from the outside even when being stored. The above mentioned prior art is disclosed in Japanese Patent Application Laid-Open No. 63-63485.

SUMMARY OF THE INVENTION

It is an object of the present invention to provide a scissors which can be smoothly used by both right-handed and left-handed users, is easily held or stored without projecting the handle portion outward in non-use, and can enhance appearance quality.

Means for Solving the Problems

In order to eliminate the problems, in accordance with a first aspect of the invention, there is provided a scissors comprising a pair of scissors constitution bodies, the pair of scissors constitution bodies including:

a cutting portion including cutter blades formed on both sides in a width direction; and a holding portion formed continuously from the cutting portion, wherein the pair of scissors constitution bodies are rotatably joined by a shaft portion in a base end portion of the cutting portion, and the pair of scissors constitution bodies cross and rotate in both directions through the shaft portion, and wherein the holding portion includes a handle portion mounted therein so as to be visually unrecognized from the outside, the handle portion projected only in one width direction, and a slider provided in the holding portion is operated to form a handle portion.

Therefore, in the first aspect of the invention, the users can dispose the pair of scissors constitution bodies in a form easy to be used according to their dominant hands in use, and can project the handle portion only in one width direction to constitute and use the scissors.

In accordance with a second aspect of the invention, the holding portion includes a cavity portion therein and is formed in an elongate rod shape, and the handle frame portion having flexibility is mounted in the cavity portion;

wherein opening portions from which the handle frame portion can be projected in a width direction are respectively formed along a length direction in both side surface portions of the holding portion in the width direction, and a slider opening portion is formed along the length direction in a top face of the holding portion; and wherein the handle frame portion has an end portion fixed to the holding portion and a tip end portion fixed to the slider disposed in the slider opening portion, and the slider is slid toward a back end portion to bend the handle frame to project the handle frame to the outside of the holding portion from the opening portion.

In accordance with a third aspect of the invention, the holding portion is formed in an elongate rectangular shape, and the handle frame portion has a back end portion fixed to the back end portion of the holding portion.

Therefore, in accordance with the third aspect of the invention, the users can slide the slider toward the back end portion to project the handle frame portion in one width direction of the holding portion to form the handle portion.

The slider is returned toward the tip end portion of the holding portion in non-use to store the handle frame portion in the holding portion.

In accordance with a fourth aspect of the invention, a projection preventing member can be inserted into the opening portions; and the projection preventing member is inserted into one of the opening portions to regulate the projection of the handle frame portion, thereby projecting the handle frame portion in the width direction from the other opening portion of the holding portion.

Therefore, in accordance with the fourth aspect of the invention, when the slider is operated, the handle frame portion abuts on the projection preventing member, and is projected from the opposite opening portion in the width direction.

In accordance with a fifth aspect of the invention, the holding portion and the handle frame portion are made of a synthetic resin.

Effects of the Invention

In accordance with the first and second aspects of the invention, it is not necessary for users to pull out the handle forming portion in the width direction of the holding portion with fingers to form the handle portions as in the conventional technique. The handle frame is projected in the width direction by operating the slider to form the handle portion. Accordingly, the handle portion can be easily formed, and as a result, the scissors can be smoothly used.

The slider can be returned toward the tip end portion of the holding portion in non-use to store the handle frame portion in the holding portion, whereby the handle portion is not projected outward in non-use. Therefore, there can be provided the scissors which can be formed in one rod shape to the cutting portion from the holding portion, is easily held and stored wholly, and can enhance the appearance quality.

In accordance with the fourth aspect of the invention, the users can slide the slider toward the back end portion to project the handle frame portion in one width direction of the holding portion to form the handle portion. Accordingly, the users can easily project the handle frame portion only in any width direction based on the judgements by the users.

In accordance with the fifth aspect of the invention, the holding portion and the handle frame portion are made of the synthetic resin, whereby there can be provided the light-weight scissors which can reduce the manufacture cost.

DETAILED DESCRIPTION OF THE INVENTION

Hereinafter, the present invention will be described in detail based on an embodiment shown in the accompanying drawings.

Figure 1:
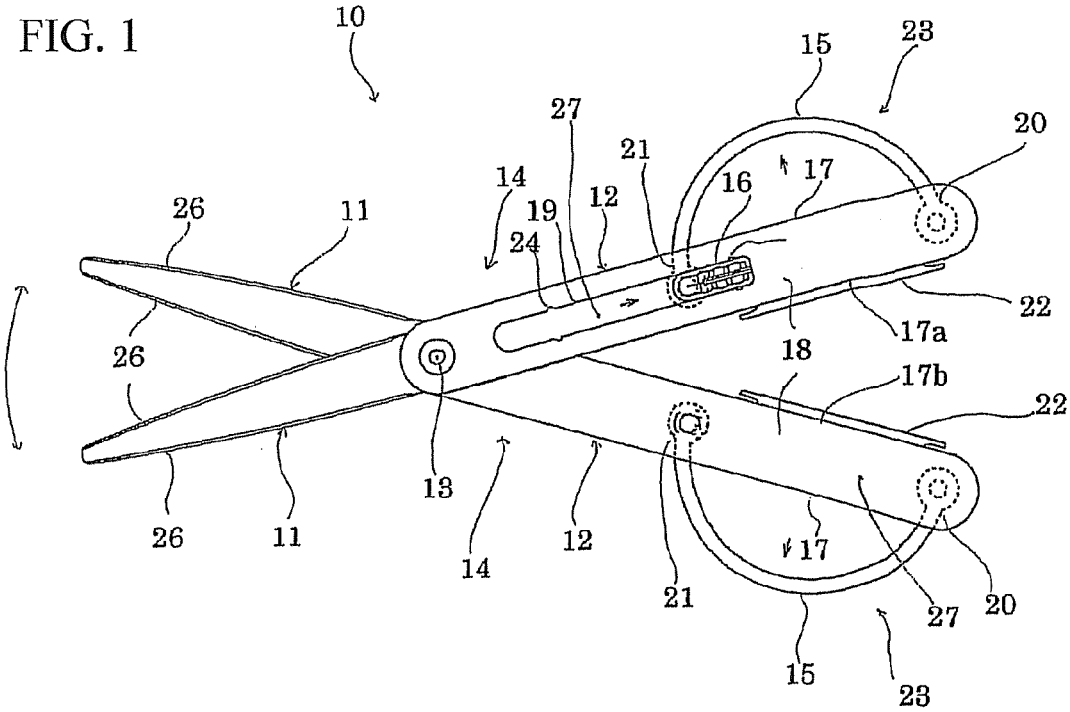
FIG. 1 is a plan view showing an embodiment of a scissors according to the present invention, and shows a state where a cutting portion is opened and a handle portion is formed.

As shown in FIG. 1, a scissors 10 according to this embodiment has a pair of scissors constitution bodies 14 and 14 having a cutting portion 11 and a holding portion 12 formed continuously from the cutting portion 11. The cutting portion 11 has cutter blades 26 and 26 formed on both sides in a width direction. The pair of scissors constitution bodies 14 and 14 are rotatably joined by a shaft portion 13 in the base end portion of the cutting portion 11. The pair of scissors constitution bodies 14 and 14 cross and rotate in both directions (arrow directions) through the shaft portion 13.

The holding portion 12 is formed so as to have a cavity portion 27 therein. A handle frame portion 15 projected only in one width direction is mounted in the cavity portion 27 so that the handle frame portion 15 is visually unrecognized from the outside. A handle portion 23 can be formed outward by operating a slider 16 provided in the holding portion 12.

In this embodiment, the holding portion 12 and the handle frame portion 15 are made of a synthetic resin, and the handle frame portion 15 is formed with a narrow width. Accordingly, when the handle frame portion 15 is compressed in a length direction, the handle frame portion 15 is formed so as to easily bend in a horizontal direction.

The holding portion 12 is wholly formed in an approximately elongate rectangular parallelepiped shape, and the rod-like handle frame portion 15 having flexibility is mounted in the holding portion 12. Opening portions 17 and 17 from which the handle frame portion 15 can project in a width direction are respectively formed along a length direction in both side surface portions of the holding portion 12 in the width direction. A slider opening portion 19 is formed along the length direction in a plane portion 18 of the holding portion 12.

The handle frame portion 15 has a back end portion 20 fixed to a back end portion of the holding portion 12, and a tip end portion 21 fixed to the slider 16 disposed in the slider opening portion 19.

In the tip end portion and back end portion of the slider opening portion 16, engaging recesses 24 and 25 are formed. An engaging portion (not shown) which is formed in the slider 16 is engaged with the engaging recesses 24 and 25, whereby the handle frame portion 15 can be fixed in the storage and projection states.

The opening portions 17 and 17 are formed so that a trapezoidal projection preventing member 22 (in a side view) can be inserted into and fixed to the opening portions 17 and 17. The projection preventing member 22 is inserted into the opening portion 17 opposite to the width direction where the handle frame portion 15 is projected to regulate the projection of the handle frame portion 15. Accordingly, the handle frame portion 15 can be projected only in one width direction of the holding portion.

As a result, in this embodiment, the slider 16 is slid toward the back end portion of the holding portion 12 to bend the handle frame portion 15 and project the handle frame portion 15 to the outside of the holding portion 12 from the opening portions 17 and 17.

Hereinafter, the operation of the scissors 10 according to this embodiment will be described.

Figure 2:
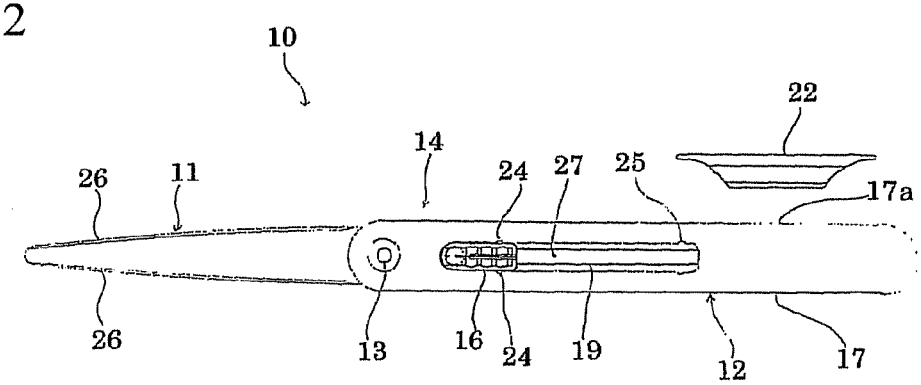
FIG. 2 shows an embodiment of a scissors according to the present invention, and is a plan view showing a state before a projection preventing member is inserted when a handle portion is formed.
Figure 3:
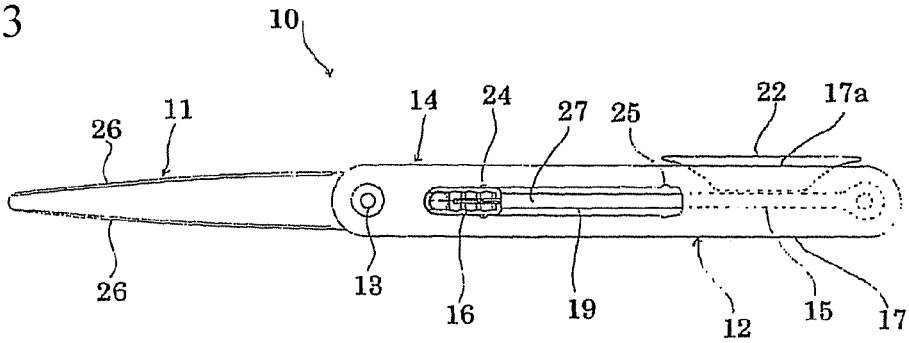
FIG. 3 shows an embodiment of a scissors according to the present invention, and is a plan view showing a state after a projection preventing member is inserted when a handle portion is formed.
Figure 4:
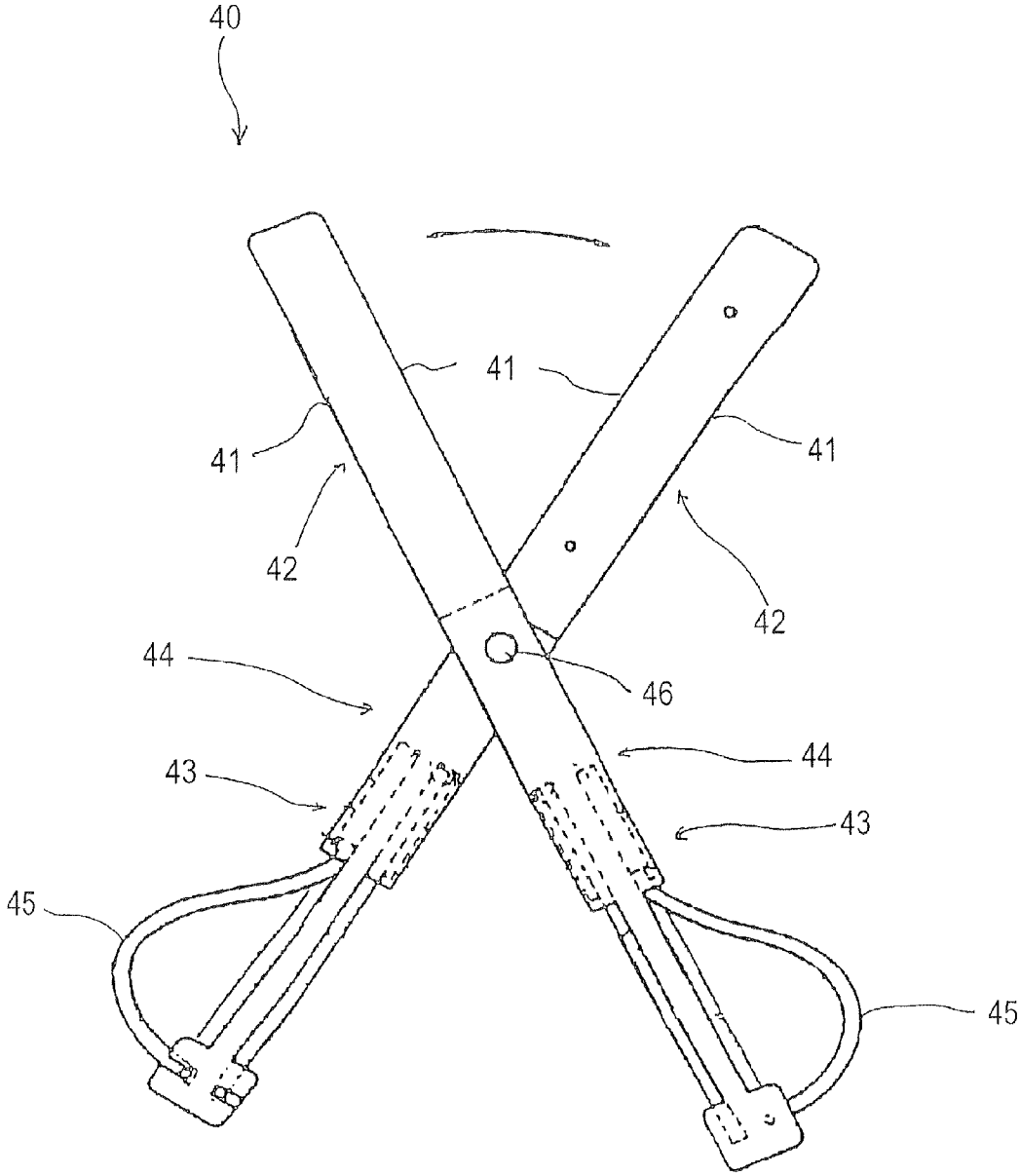
FIG. 4 PRIOR ART
FIG. 4 is a plan view showing an example of a conventional ambidextrous scissors.

When the scissors 10 according to this embodiment is used, as shown in FIGS. 2 and 3, first, the projection preventing member 22 is inserted into an opening portion 17*a* of the opening portions 17 and 17 of the holding portion 12 of one of the scissors constitution bodies 14 and 14 in the width direction. In the state, the slider 16 is removed from the engaging recess 24 and pulled toward the back end portion of the holding portion 12. The slider 16 is then locked with the engaging recess 25.

Accordingly, as shown in FIG. 1, the handle frame portion 15 mounted in the holding portion 12 abuts on the projection preventing member 22, whereby the handle frame portion 15 is projected so as to bend and swell outward from the opening portion 17 which is not blocked by the projection preventing member 22 to form the handle portion 23.

Similarly, the projection preventing member 22 is inserted into an opening portion 17*b* of the other scissors constitution body 14 facing the opening portion 17 of one of the scissors constitution bodies 14 and 14 into which the projection preventing member 22 has been inserted. Accordingly, the handle frame portion 15 is projected so that the handle frame portion 15 faces the handle frame portion 15 projected to the outside of one of the scissors constitution bodies 14 and 14. Thus, the handle frame portions 15 are mutually symmetric. As shown in FIG. 1, a pair of handle portions 23 and 23 is formed.

As shown in FIG. 1, in this state, the scissors 10 is suitably used by inserting fingers into the handle portions 23 and 23 with right hands or left hands according to users' dominant hands, holding the holding portions 12 and 12, and rotating the scissors constitution bodies 14 and 14 through the shaft portion 13.

When the scissors 10 is not used, as shown in FIGS. 2 and 3, the slider 16 is returned toward the tip end portion, and is locked with the engaging recess 24, whereby the handle frame portion 15 is mounted in the holding portion 12.

Therefore, in the scissors 10 according to this embodiment, it is not necessary for users themselves to pull out the handle forming portion in the width direction of the holding portion 12 to form the handle portions 23 and 23 as in the conventional technique. The handle frame portion 15 is projected in the width direction by operating the slider 16 to form the handle portion 23. Accordingly, the handle portion 23 can be easily formed, and as a result, the scissors 10 can be smoothly used.

The users can slide the slider 16 toward the back end portion to project the handle frame portion 15 in one width direction of the holding portion 12 to form the handle portion 23. Accordingly, the users can easily project the handle frame portion 15 only in any width direction based on the judgements by the users.

When the scissors 10 is not used, the slider 16 can be returned toward the tip end portion of the holding portion 12 to store the handle frame portion 15 in the holding portion 12. Accordingly, as shown in FIGS. 2 and 3, the handle portion is not projected outward in non-use. Therefore, the scissors 10 can be formed in one rod shape to the cutting portion 11 from the holding portion 12, and the scissors 10 is easily held and stored wholly. In addition, the appearance quality of the scissors 10 can be enhanced.

Since the holding portion 12 and the handle frame portion 15 are made of the synthetic resin, this embodiment can provide the lightweight scissors which can reduce the manufacture cost.

INDUSTRIAL APPLICABILITY

The present invention can be widely applied to the scissors which can be used by both the right-handed and left-handed users.

What is claimed is:

1. A scissors comprising:

a pair of scissors constitution bodies each having a length extending in a longitudinal, length direction and a width extending in a lateral, width direction, the constitution bodies each comprising a cutting portion at one constitution body end and having cutting edges formed on lateral sides thereof opposing one another in the width direction; and a holding portion at the other constitution body end having an elongate rectangular shape and extending continuously from a base end portion of the cutting portion in the length direction;

wherein the constitution bodies are rotatably joined to one another by a shaft portion disposed in the base end portion of the cutting portion so that the constitution bodies cross one another and rotate through the shaft portion; and wherein each of the holding portions includes a handle frame portion having a first end that is fixed to a longitudinally translocatable slider mechanism provided in a slider opening portion extending in the longitudinal direction on a planar surface of the holding portion and in communication with an elongate, rod-shaped cavity formed within the holding portion, and an opposed second end that is fixed to a portion of the holding portion within the cavity, each of the holding portions further including opening portions which extend in the length direction on lateral sides of the holding portion opposing one another in the width direction and each of the opening portions are in communication with a respective one of the cavities, wherein when each of the slider mechanisms are in a first position longitudinally proximate a respective one of the base end portion of the cutter portion, each of the handle frames are fully situated within the respective one of the cavities of the holding portion, and when each of the slider mechanisms are in a second position longitudinally distal with respect to a respective one of the base end portions of the cutter portion in the length direction, each of the handle frames extend outwardly from a respective one of the lateral sides of the holding portion in the width direction through a respective one of the opening portions on the lateral sides of the holding portion that is not restricted by a removable insert member which, when inserted into the other of the opening portions, prevents outward extension of the handle frame therethrough in the width direction.

2. The scissors according to claim 1, wherein each of the holding portions and each of the handle frame portions are made of a synthetic resin.

* * * * *